United States Patent [19]

Antonious

[11] Patent Number: 4,938,470

[45] **Date of Patent: * Jul. 3, 1990**

[54] PERIMETER WEIGHTED IRON TYPE GOLF CLUB HEAD WITH UPPER ALIGNMENT AND SIGHTING AREA AND COMPLEMENTARY WEIGHTING SYSTEM

[76] Inventor: Anthony J. Antonious, 205 E. Joppa Rd., Towson, Md. 21204

[ * ] Notice: The portion of the term of this patent subsequent to May 2, 2006 has been disclaimed.

[21] Appl. No.: 289,259

[22] Filed: Dec. 23, 1988

[51] Int. Cl.[5] ..... A63B 53/04

[52] U.S. Cl. ..... 273/164; 273/169; 273/167 H

[58] Field of Search ..... 273/167–175, 273/163 R, 164; D21/219, 220

[56] References Cited

U.S. PATENT DOCUMENTS

D. 165,458 12/1951 Jacobs ..... 273/169 X
D. 269,101 5/1983 Reymann et al. ..... D21/220
1,671,956 5/1928 Sime ..... 273/167 F
4,345,763 8/1982 Swanson ..... 273/164
4,826,172 5/1989 Antonious ..... 273/169

*Primary Examiner*—Edward M. Coven
*Assistant Examiner*—Sebastiano Passaniti
*Attorney, Agent, or Firm*—N. J. Aquilino

[57] ABSTRACT

A perimeter weighted iron type golf club head having an upper alignment and sighting area formed on a top ridge of the club head approximate the toe and positioned perpendicular to the intended line of flight and parallel to the longitudinal axis of the club face to aid the golfer in aligning the club head square to the intended line in the address position. The club also includes an improved weight configuration formed of weight members having a concentrated mass within the rear cavity on the club head which are positioned adjacent to and on opposite sides of the center of percussion and located between the center of percussion and the peripheral mass of the golf club head.

9 Claims, 4 Drawing Sheets

PERIMETER WEIGHTED IRON TYPE GOLF CLUB HEAD WITH UPPER ALIGNMENT AND SIGHTING AREA AND COMPLEMENTARY WEIGHTING SYSTEM

BACKGROUND OF THE INVENTION

The present invention relates to iron type golf club heads, and in particular, to an improved peripheral weighted iron type golf club head having an alignment and sighting means on its upper top ridge surface and a complementary weight system adjacent the center of percussion at the rear of the club head.

Conventional type iron golf club heads include a top ridge on the top of a club which diverges in an angular direction upwardly and outwardly from the hosel toward the toe of the club head. This conventional structure has been developed for iron type club heads to maximize the weighting characteristics of the club head and to maximize the ball striking surface on the club head. This distribution of the weight toward the toe balances the club head while maintaining the center of percussion generally near the center of the ball striking face. A shortcoming of this type of design is that the top edge or top ridge line of the club head, because of the diverging direction, makes it impossible to use for alignment purposes.

Various attempts have been made to provide a club head with a rectangular club face and top line extending straight across the entire length of the ball striking face in a direction perpendicular to the intended target line for alignment purposes, for example, as shown in the Swanson U.S. Pat. No. (4,345,763).

Peripheral weighted golf club heads are also quite well known in the art as evidenced by the patent to Solheim (D-276,644). These types of clubs are generally more forgiving of golf shots struck off the center of percussion and toward the periphery of the club head because most of the mass is located in these areas thus maximizing energy transfer to the golf ball even though the center of percussion is not precisely hit. Although these type of club heads provide improved performance when a golfer miss-hits a ball, there is still a sacrifice in appreciable distance and accuracy when the ball is miss-hit. A particular shortcoming of this type of golf club head is a loss of feel and/or control when a ball is miss-hit off of the precise center of percussion.

SUMMARY OF THE INVENTION

The present invention provides a more improved golf club head having the advantages of peripheral weighted club heads while including alignment features to enable a golfer to properly align a club to the ball and to the intended target prior to executing a golf shot and a weighting configuration which enhances the shot making ability of the club when a ball is struck away from the precise center of percussion.

The perimeter weighted golf club head of the present invention includes a peripheral mass on the rear face formed at least on the heel, toe and bottom portions of the club head which defines a cavity or recess in the back of the club head. The club head further includes a sighting or alignment means formed on the uppermost portion of the top ridge toward the toe which enables a player at address to position a club head square to the intended line of flight. The sighting section is formed parallel to the longitudinal axis of the club head between the toe and heel of the club face and adjacent to and substantially at the toe portion of the club head. The sighting section is substantially parallel to the sole of the club head so that when a club is placed in the address position, the sighting section is perpendicular to the intended line of flight. The weight, removed from the toe portion to form the parallel sighting section, is redistributed and located adjacent the center of percussion in the form of concentrated mass weight members vertically disposed within the cavity between the club's center of percussion and the peripheral mass of the club head at points which are located adjacent the center of percussion and which are positioned in back of the club face areas where golf balls are more frequently struck on the club face when the center of percussion is miss-hit. In a preferred embodiment, the concentrated mass weight members are longitudinal in shape and extend from the bottom to the top of the club head within the rear cavity formed by the peripheral mass between the center of percussion and the toe and between the center of percussion and the heel of the club head. This improved golf club head provides an alignment means to enable a user to position the club head properly and also a concentrated mass weighting means to provide a solid feel when a ball is struck off of the center of percussion, thereby producing greater accuracy and improved feel which permits golf balls to travel further and straighter with a more accurace trajectory.

Among the objects of the present invention are to provide a peripheral weight iron type golf club head including a sighting and alignment means and a weighting system to provide improved feel, control, accuracy and distance when a golf ball is struck. Another object is to provide an iron type golf club head wherein a novel weight distribution provides an improved sighting area and also a more solid mass adjacent the center of percussion.

These and other objects will become apparent with reference to the accompanying drawings and following specification which illustrates the embodiments of the invention.

DESCRIPTION OF THE PREFERRED EMBODIMENTS

Figure 1:
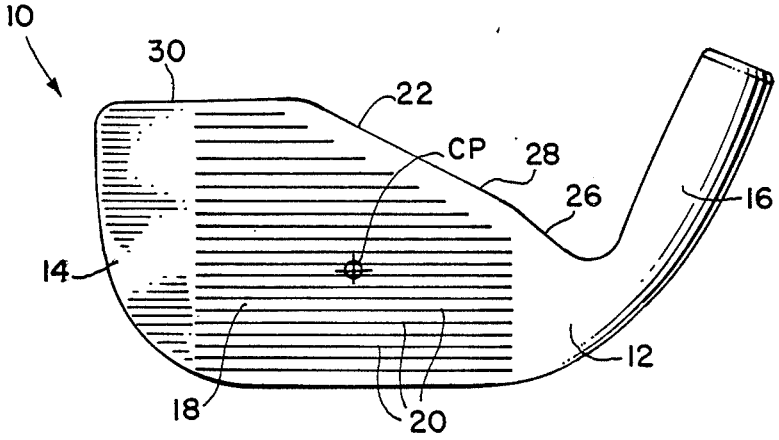
FIG. 1 illustrates a front elevational view of an iron type golf club head in accordance with the present invention.

Referring to the drawings, the preferred embodiments of the present invention are illustrated. Wherever possible, the same or like reference numerals are used throughout the drawings to refer to the same or like parts.

The drawings illustrate one embodiment of the golf club head 10 of the present invention. The club head 10 is a peripheral weighted iron type golf club head including a heel 12, toe 14, hosel 16, ball striking face 18 having a loft angle of at least 12 degrees and complementary rear face. The club head has a center of percussion CP shown on the ball striking face. The center of percussion is preferably located approximately at the center or center of gravity CG of the club head, the exact position being precisely controlled by the weight distribution on the club head itself and it represents the spot where a ball would ideally be struck to provide maximum transfer of energy during the swing for maximum distance and control.

The ball striking face further includes a plurality of grooves 20 of conventional design which, when viewed by a golfer, are perpendicular to the normal intended line of flight.

The club head has an upper surface including a top ridge 22 which extends upwardly and outwardly from the heel 12 toward the toe 14 of the club head 10. In the embodiment shown, the top ridge 22 includes a first section 26 adjacent the heel which extends at a steep angle away from the heel, a second intermediate section 28 also extending at a divergent angle from the heel toward the toe, and a third sighting section 30 which extends substantially horizontally between the toe 14 and the heel 12 and parallel to the grooves 20 and perpendicular to the intended line of flight.

The sighting section 30 forms a flat area located above the ball striking face 18 between the toe 14 and the heel 12 on the top ridge section 22. The sighting section 30 extends partway across the width of the club head and above the ball striking face 18 at a substantial distance from the hosel 16. In a preferred embodiment, as shown, the length of the sighting section 30 is approximately one-third ($\frac{1}{3}$) to one-half ($\frac{1}{2}$) the longitudinal distance of the club head 10. However, it will be appreciated that the sighting may extend longer or shorter between the toe 14 and heel 12 in keeping within the spirit and scope of the invention as shown in the embodiments or the club heads shown in FIGS. 10 and 11. Preferably, the upper surface would be flat and generally parallel to the bottom surface or sole 32 of the club head 10. This insures that the sighting section 30 is parallel to the ground surface and perpendicular to the intended line of flight when the club head is placed in the shot-making position.

Figure 2:
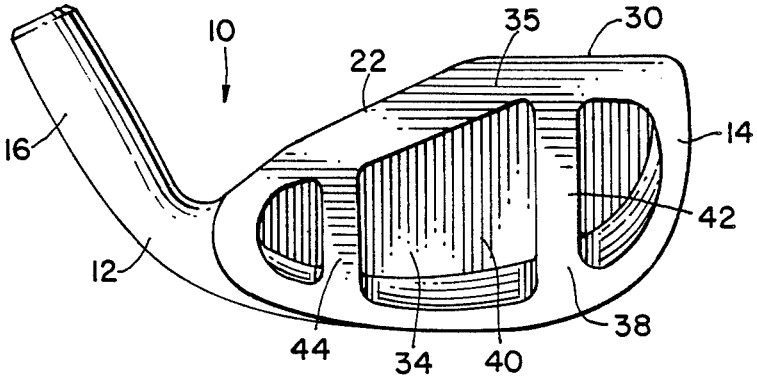
FIG. 2 is a rear elevational view of the iron type golf club head of FIG. 1.

Referring to FIG. 2, the club head 10 includes a rear face 34 having an outer rear surface 35 and an inner rear surface 36. A plurality of cavities 39, 40 and 41 are formed by a peripheral weight 38 which extends around the perimeter of the club head 10 in conjunction with a pair of longitudinal, concentrated mass weight members 42 and 44. These weight members 42 and 44 are generally perpendicular to the club head 10 between the upper and lower surfaces thereof, one being located between the heel 12 and the center of percussion (CP) and the other being located between the toe 14 and the center of percussion (CP). The weight members 42 and 44, in effect, redistribute the weight of the upper toe portion of the club head 10 which is removed to form the sighting section.

By removing the weight from the upper toe portion and placing it directly adjacent the center of percussion, the overall weight of the club head remains practically unchanged. However, the location of the concentrated mass weight members directly adjacent the center of percussion and between the center of percussion and the toe and heel of the club head respectively provides a golf club head which produces a more solid feel when the ball is struck off of the precise center of percussion and also a more solid feel if the ball is struck directly at the center of percussion. The improved weighting system transfers additional energy to the ball producing a more solid feel than with other similar golf clubs of this type.

Figure 3:
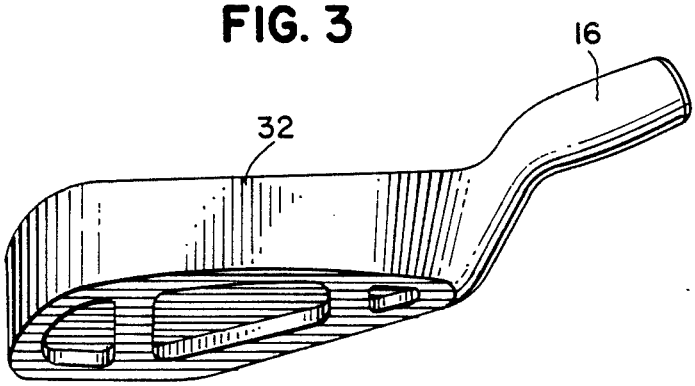
FIG. 3 is a bottom view thereof.

FIGS. 4 through 9 illustrate embodiments of iron type golf club heads which are identical to the club head described with reference to FIGS. 1 to 3 except for the size and/or shape and placement of the concentrated mass weight members located within the cavity.

Figure 4:
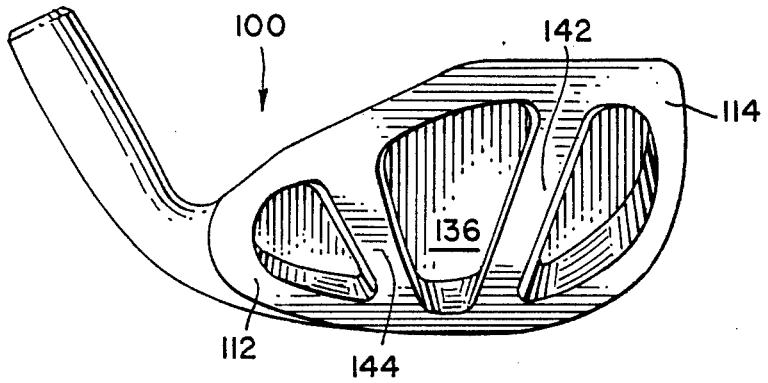
FIG. 4 is a rear elevational view of a second embodiment of the present invention.

FIG. 4 shows the club head 100 having a pair of longitudinal, concentrated mass weight members 142 and 144 which are positioned at an angle within the cavity 136 so that the upper portion of the weight members 142 and 144 are closer to the toe 114 and heel 112, respectively.

Figure 5:
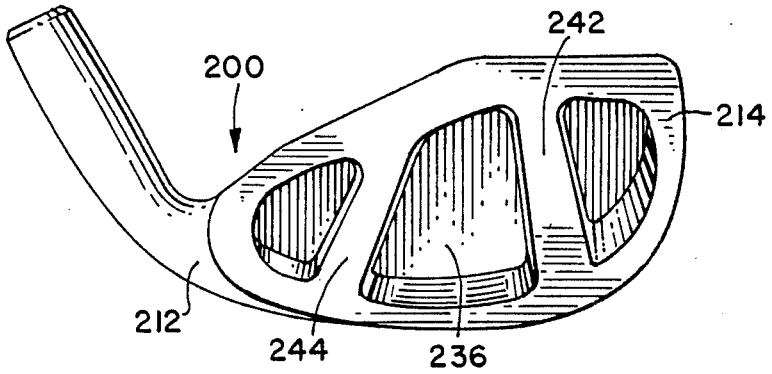
FIG. 5 is a rear elevational view of a third embodiment of the present invention.

FIG. 5 illustrates a third embodiment of an iron type golf club head 200 wherein the longitudinal weight members 242 and 244 are positioned within the cavity 236 so that their lower portions are closer to the toe 214 and heel 212, respectively.

Figure 6:
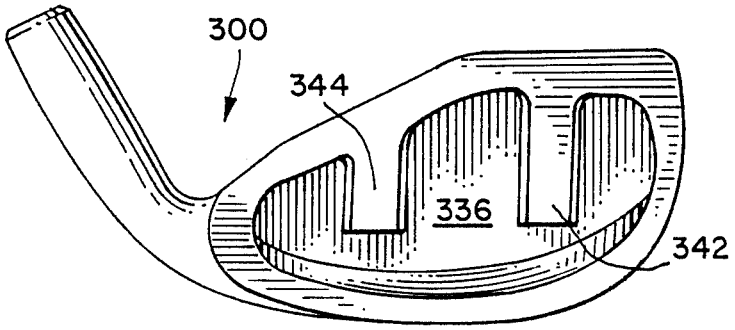
FIG. 6 is a rear elevational view of a fourth embodiment of the present invention.

FIG. 6 illustrates a fourth embodiment of an iron type golf club head 300 of the present invention wherein longitudinal weight members 342 and 344 extend downwardly only partway into the cavity 336.

Figure 7:
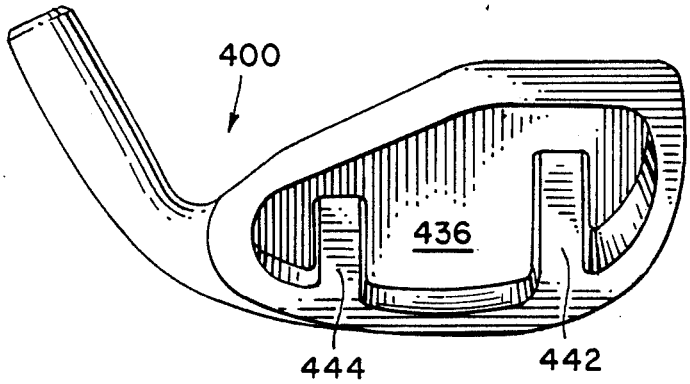
FIG. 7 is a rear elevational view of a fifth embodiment of the present invention.

FIG. 7 illustrates a fifth embodiment of an iron type golf club head 400 of the present invention wherein longitudinal weight members 442 and 444 extend upwardly only partway into the cavity 436.

Figure 8:
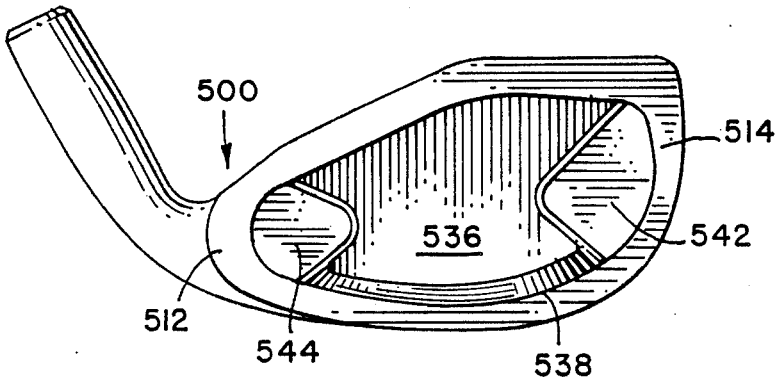
FIG. 8 is a rear elevational view of a sixth embodiment of the present invention.

FIG. 8 illustrates a sixth embodiment of an iron type golf club head 500 of the present invention wherein the weight members 542 and 544 are geometrical masses integrally formed with the peripheral weight 538 adjacent the toe 514 and heel 512, respectively, and also which extend into the cavity 536 so as to be located on opposite sides of the center of percussion (not shown).

Figure 9:
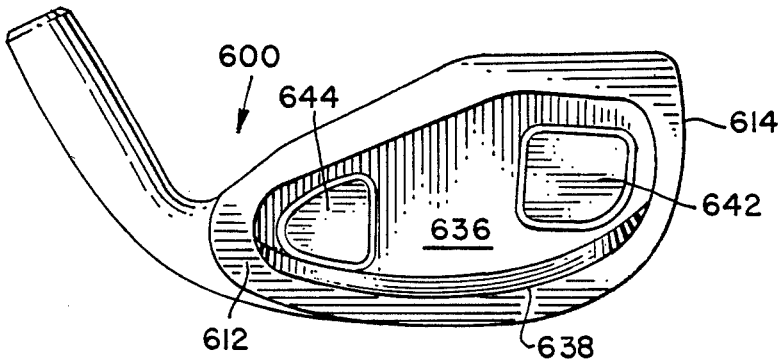
FIG. 9 is a rear elevational view of a seventh embodiment of the present invention.

FIG. 9 illustrates a seventh embodiment of an iron type golf club head 600 of the present invention wherein weight members 642 and 644 are located within the cavity and separated from the peripheral mass 638 adjacent the toe 614 and heel 612, respectively.

Figure 10:
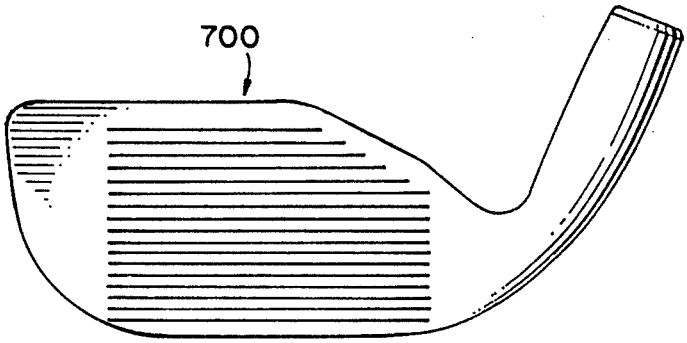
FIG. 10 is a front elevational view of an eighth embodiment of the present invention.
Figure 11:
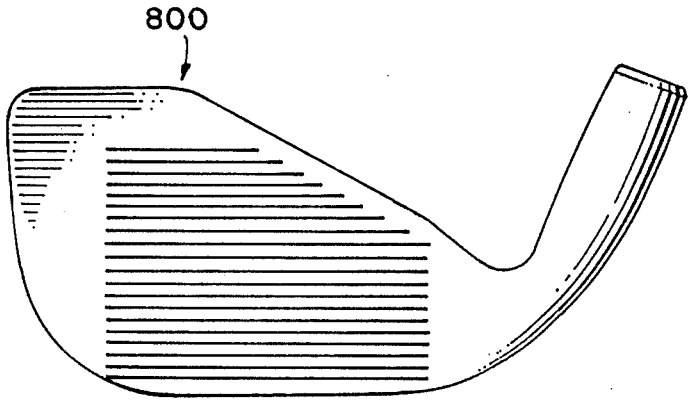
FIG. 11 is a front elevational view of a ninth embodiment of the present invention.

FIGS. 10 and 11 illustrate two additional embodiments of an iron type golf club head in accordance with the present invention wherein the length of the sighting section varies from approximately two-thirds ($\frac{2}{3}$) of the longitudinal distance of the club head 700, as shown in FIG. 10, to approximately one-third ($\frac{1}{3}$) of the longitudinal distance of the club head 800, as shown in FIG. 11. It will be further appreciated that either of these two embodiments of FIGS. 10 and 11 may be combined with any of the various weight member configurations shown in FIGS. 2 and 4 through 9.

Thus, the golf club head of the present invention includes a peripheral weighting configuration in combination with a sighting and alignment feature and a weighting system which transfers maximum energy to a ball which is struck off of the precise center of percussion. This golf club head thereby maximizes the chances of hitting the ball on its proper trajectory path.

It will further be appreciated that the improved golf club head has been described with respect to the specific embodiments as shown and still other changes and modifications may be made without departing from the spirit and scope of the invention as defined in the appended claims.

I claim:

1. An iron type golf club head having an improved weight distribution and sighting and alignment means comprising:

a main body including a heel, hosel proximate said heel, a toe, a bottom surface including a sole, a ball striking face to hit a ball along an intended line of flight, a center of percussion on said ball striking face, a rear surface, a complementary rear face and a top ridge extending from the hosel to the toe;

sighting and alignment means formed on a portion of said top ridge of said golf club head, said sighting and alignment means including a straight section on said top ridge extending in a direction perpendicular to the intended line of flight from a first point adjacent said toe to a second point located between said toe and said heel, and spaced substantially from said hosel;

a peripheral mass formed on at least the heel, toe and lower surface portions of the outer periphery of the rear surface of the club head, said peripheral mass defining a cavity at the rear surface of the club head and providing a perimeter weighting for the club head; and at least two opposing weight members formed on the rear surface of the club head and extending outwardly from said rear surface to at least the rearmost outer surface of said peripheral mass, the respective opposing weight members being located on opposite sides of and spaced from the center of percussion, one weight member being positioned between and spaced from the center of percussion and the toe portion of said peripheral mass, the second opposing weight member being positioned between and spaced from the center of percussion and the heel portion of said peripheral mass, said first and second weight members providing a mass for improved club head stabilization and energy transfer to a golf ball struck off the center of percussion.

2. The golf club head of claim 1 further characterized by said ball striking face having a loft angle of at least 12 degrees.

3. The golf club head of claim 1 wherein said sighting and alignment means extends approximately half way between said heel and said toe.

4. An iron type golf club head having an improved weight distribution and sighting and alignment means comprising:

a main body including a heel, hosel proximate said heel, a toe, a bottom surface including a sole, a ball striking face to hit a ball along an intended line of flight, a center of percussion on said ball striking face, a complementary rear face including an outer rear surface and an inner rear surface, and an upper surface including a top ridge extending from the hosel to the toe;

sighting and alignment means formed on a portion of said top ridge of said golf club head, said sighting and alignment means including a straight section on said top ridge extending in a direction perpendicular to the intended line of flight from a first point adjacent said toe to a second point located between said toe and said heel, and spaced substantially from said hosel;

a peripheral mass formed on said rear face adjacent at least said heel, toe and bottom surface of said club head on the outer periphery thereof, said peripheral mass defining at least one cavity formed by said peripheral mass, said cavity having a bottom, planar in shape, and forming said inner rear surface behind said ball striking face, the outer rear edge of said peripheral mass forming said outer rear surface; and at least two opposing weight members located on said inner rear surface and extending between said upper surface and said bottom surface of said club head and being located apart from and on opposite sides of said center of percussion and between said center of percussion and opposing sides of said peripheral mass, said weight members projecting above said inner rear surface to at least said outer rear surface located on said peripheral mass and providing a stabilizing means between said center of percussion and said peripheral mass for providing improved energy transfer to a golf ball being struck off the center of percussion.

5. The golf club head of claim 4 further characterized by said ball striking face having a loft angle of at least 12 degrees.

6. The golf club head of claim 4 wherein said sighting and alignment means extends approximately half way between said heel and said toe.

7. An iron type golf club head having an improved weight distribution and sighting and alignment means comprising:

a main body including a heel, hosel proximate said heel, a toe, a bottom surface including a sole, a ball striking face to hit a ball along an intended line of flight, a center of percussion on said ball striking face, a complementary rear surface and an upper surface including a top ridge extending from the hosel to the toe, characterized by a plurality of cavities formed in said rear surface; said plurality of cavities including a first cavity being located adjacent said heel, a second cavity being located adjacent said toe, and a third cavity centrally located rearwardly of said center of percussion, said cavities being formed by peripheral masses on, at least, said heel, said toe and said bottom surface at the outer periphery of said rear surface of said club head, and a pair of vertically disposed masses extending between said upper surface and said bottom surface, the first of said vertical masses being located between said center of percussion and said toe and the second of said vertical masses being located between said center of percussion and said heel of said club head; each of said vertical masses separating one of two of said cavities from the other; and sighting and alignment means formed on a portion of said top ridge of said golf club head, said sighting and alignment means including a straight section on said top ridge extending in a direction perpendicular to the intended line of flight from a first point adjacent said toe to a second point located between said toe and said heel, and spaced substantially from said hosel.

8. The golf club head of claim 7 further characterized by said ball striking face having a loft angle of at least 12 degrees.

9. The golf club head of claim 7 wherein said sighting and alignment means extends approximately half way between said heel and said toe.

* * * * *